US007922282B2

(12) United States Patent
Shindo et al.

(10) Patent No.: US 7,922,282 B2
(45) Date of Patent: Apr. 12, 2011

(54) CAP APPARATUS FOR LIQUID JETTING HEAD AND LIQUID JETTING APPARATUS

(75) Inventors: Tatsuya Shindo, Nagoya (JP); Takamasa Usui, Ogaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 747 days.

(21) Appl. No.: 11/974,539

(22) Filed: Oct. 15, 2007

(65) Prior Publication Data

US 2008/0088666 A1 Apr. 17, 2008

(30) Foreign Application Priority Data

Oct. 16, 2006 (JP) ..... 2006-280905

(51) Int. Cl.
*B41J 2/165* (2006.01)

(52) U.S. Cl. ..... 347/29

(58) Field of Classification Search ..... 347/29, 347/31

See application file for complete search history.

(56) References Cited

U.S. PATENT DOCUMENTS

| | | | | |
|---|---|---|---|---|
| 5,631,683 | A * | 5/1997 | Nishioka et al. | 347/87 |
| 6,203,136 | B1 | 3/2001 | Takahashi et al. | |
| 6,481,826 | B1 * | 11/2002 | Hara et al. | 347/29 |
| 6,722,757 | B2 | 4/2004 | Saito | |
| 6,837,566 | B2 * | 1/2005 | Mitsuzawa et al. | 347/23 |
| 6,874,873 | B2 * | 4/2005 | Thielman et al. | 347/85 |
| 7,195,334 | B2 | 3/2007 | Nakamura | |
| 2005/0253488 | A1 | 11/2005 | Ito | |

FOREIGN PATENT DOCUMENTS

| | | |
|---|---|---|
| JP | 9-39258 | 2/1997 |
| JP | 11300981 | 11/1999 |
| JP | 2000062202 | 2/2000 |
| JP | 2000062202 A * | 2/2000 |
| JP | 200380737 | 3/2003 |
| JP | 2003251828 | 9/2003 |
| JP | 2004142422 | 5/2004 |
| JP | 2005231242 | 9/2005 |
| JP | 2005313428 | 11/2005 |
| JP | 2005322850 | 11/2005 |

* cited by examiner

*Primary Examiner* — Julian D Huffman
*Assistant Examiner* — Jason S Uhlenhake
(74) *Attorney, Agent, or Firm* — Frommer Lawrence & Haug LLP

(57) ABSTRACT

A cap apparatus includes a cap which seals nozzles of a liquid jetting head, an absorber which is accommodated tightly inside the cap, a cap holder which is accommodated tightly inside the cap, and a holder which has a holding body which makes a contact with an upper surface of the absorber, a pin which is protruded downward from the holding main portion, and an engaging portion which is provided on a front end of the pin. Through holes which make the cap, the absorber, and the cap holder communicate, are formed in the cap, the absorber, and the cap holder. Since the through holes function as a passage, it is possible to improve an assembling workability of the cap apparatus.

18 Claims, 14 Drawing Sheets

CAP APPARATUS FOR LIQUID JETTING HEAD AND LIQUID JETTING APPARATUS

CROSS-REFERENCE TO RELATED APPLICATION

The present application claims priority from Japanese Patent Application No. 2006-280905, filed on Oct. 16, 2006, the disclosure of which is incorporated herein by reference in its entirety.

BACKGROUND OF THE INVENTION

1. Field of the Invention

The present invention relates to a cap apparatus for a liquid jetting head, and a liquid jetting apparatus.

2. Description of the Related Art

An ink-jet printer has hitherto been known as an example of a liquid jetting apparatus which jets a liquid from nozzles in a liquid jetting head. In the ink-jet printer, there is a possibility that jetting quality is affected by blocking of nozzles due to mixing of air in an ink, evaporation of an ink solvent, and thickening of ink inside an ink-jet head. Therefore, the ink-jet printer is provided with a cap apparatus for carrying out a purge operation by restoring the nozzles by sucking forcibly the ink from the nozzles of the ink-jet head (for example refer to Japanese Patent Application Laid-open No. 2000-62202).

As it has been described in Japanese Patent Application Laid-open No. 2000-62202, the cap apparatus includes a cap which is made of a cross-sectional recess shaped elastic material which seals the nozzles of the ink-jet head, a cap holder having a recessed shape in a cross-section which accommodates the cap, an ink absorber which is accommodated inside the cap, and a holder which holds the ink absorber. At the time of sucking of the ink-jet head, with the nozzles of the ink-jet head sealed by a surrounding portion of an opening of the cap, a suction pump which communicates with the cap apparatus depressurizes a sealed space inside the cap by a suction pressure, and the thickened ink inside the ink-jet head, or ink mixed with air bubbles is sucked from the nozzle. Moreover, the cap apparatus also plays a role of preserving the nozzles by preventing drying of the ink inside the ink-jet head by cutting off a nozzle surface of the ink-jet head from an atmosphere by sealing the nozzle surface, when the ink-jet printer is in non-printing state.

SUMMARY OF THE INVENTION

However, at the time of assembling a cap apparatus, since a cap is inserted into a cap holder while a surrounding wall of the cap makes a close contact with a surrounding wall of the cap holder, air between a sealed space generated between a bottom wall of the cap and a bottom wall of the cap holder is compressed, and an insertion resistance is developed, and it is difficult to accommodate the cap inside the cap holder. Due to this, an operator has to assemble the cap by forcing into the cap holder while avoiding a close contact with the cap holder by bending the surrounding wall of the cap, and workability is declined.

In view of this, an object of the present invention is to improve an assembling workability of a cap apparatus for a liquid jetting head.

The present invention is made in view of the abovementioned circumstances. According to a first aspect of the present invention, there is provided a cap apparatus which covers a nozzle surface, of a liquid jetting head, in which a plurality of nozzles jetting a liquid is formed, the cap apparatus including:

a cap holder which includes a first recess formed therein, and a first through hole formed in a bottom of the first recess;

a cap which is accommodated tightly inside the first recess to seal the nozzle surface, which is formed by an elastic member having a second recess formed therein, and which has a second through hole communicating with the first through hole and formed in a bottom of the second recess;

an absorber which is accommodated tightly inside the second recess of the cap to absorb the liquid, and which includes a third through hole communicating with the first through hole and the second through hole and formed to penetrate through a lower surface up to an upper surface of the absorber, the lower surface facing the bottom of the second recess; and a holding member which holds the absorber and the cap and which has a contacting portion which makes a contact with the upper surface of the absorber, a pin which protrudes from the holding portion, and an engaging portion which is provided on a front end of the pin.

The pin is inserted through the second through hole and the third through hole, and the engaging portion is engaged with the first through hole, the absorber and the cap are clamped between the contacting portion and the cap holder.

According to the first aspect of the present invention, since the first through hole (engaging hole) is formed in a bottom wall of the cap holder, at the time of assembling the cap apparatus, even when the cap having a cross-sectional recess shape is inserted tightly in the cap holder having the cross-sectional recess shape, air in a space between a bottom wall of the cap and the bottom wall of the cap holder is discharged from the engaging hole. In other words, the engaging hole of the cap holder in which the engaging portion of the holder is engaged also serves as an air-vent hole. Consequently, an insertion resistance at the time of accommodating the cap in the cap holder is reduced substantially, and an assembling workability is improved.

In the cap apparatus of the present invention, the engaging portion of the holding member may be a projection having a diameter smaller than a diameter of the pin; and the engaging portion may be press-fit into the first through hole to fix the holding member to the cap holder.

Since the engaging portion of the holder has a simple structure of a projection, it is possible to manufacture easily. Moreover, since the engaging portion is press-fitted into the engaging hole, and the absorber is clamped (pinched) assuredly between the holder and the cap holder, even when the absorber is swelled upon absorbing the liquid, it is possible to prevent assuredly the holder from being lifted up.

In the cap apparatus of the present invention, the liquid jetting head may include a plurality of nozzle rows which jet a plurality of liquids, respectively, and each of the nozzle rows may be extended in a predetermined direction;

the holding portion may be extended in the predetermined direction, and may be arranged to face the nozzle rows; and the holding portion may have a projecting portion which is projected upward, and is arranged corresponding to a position at which the nozzle rows are divided as viewed from a direction orthogonal to the predetermined direction.

When the liquid in the liquid jetting head is sucked from the nozzle, the liquid is remained on an upper surface of the absorber and the holding body. However, when a liquid of a different type is mixed, the mixed liquid may make a contact with the head surface and may be readhered, and there is a possibility that the mixed liquid is jetted when the liquid jetting head jets the liquid subsequently. Particularly, when a pigment-based liquid and a dye-based liquid are mixed, the mixture thereof tends to coagulate, and therefore it is not preferable to mix the pigment-based liquid and the dye-based liquid. For this reason, since the projecting portion of the holding body is projected upward to correspond to the position dividing the nozzle rows which jet the liquids of different types, the liquids are divided on both sides of the projecting portion according to the type, and are directed to the absorber. Consequently, the liquids of different types are suppressed from being mixed.

In the cap apparatus of the present invention, the projecting portion of the contacting portion may be projected upward at a center thereof, in a cross-section, of the contacting portion, orthogonal to the predetermined direction.

In this case, since the projecting portion at the center of the holding body is provided corresponding to the position dividing the nozzle rows, it is possible to guide the liquids jetted from the respective nozzle rows separately to the absorber, toward both sides in the direction orthogonal to the direction of extension.

In the cap apparatus of the present invention, the projecting portion of the contacting portion may have a plurality of projections which divide the nozzle rows in a cross-section orthogonal to the predetermined direction;

the contacting portion may further include a plate member which is provided to continue to each of the projections; and a through hole penetrating through the plate member in a vertical direction may be formed in the plate member.

In this case, since the plurality of projections is provided to the holding member, it is possible to divide a plurality of nozzle rows, and to direct the liquids of three or more types separately. Furthermore, since the through hole is provided in the plate member, it is possible to direct the liquid jetted on the plate member, to the absorber, via the through hole.

In the cap apparatus of the present invention, a cross-section of the projecting portion which is orthogonal to the predetermined direction may have a shape which is selected from a group consisting of a circular arc shape, a triangular shape, and a trapezoidal shape.

In this case, it is possible to make the liquid jetted from the liquid jetting head on to the upper surface of the holding portion, flow down smoothly, upon being directed to both sides in the direction orthogonal to the predetermined direction (extending direction).

In the cap apparatus of the present invention, a water repellent layer may be formed on an upper surface of the contacting portion.

In this case, the liquid jetted from the liquid jetting head is guided smoothly to the absorber by the water repellent layer of the holding body, and it is possible to prevent preferably the readhering of the jetted liquid to the head surface.

In the cap apparatus of the present invention, a suction hole which propagates a negative pressure from an outside to a space which is sealed by the liquid jetting head and the cap may be formed penetrating through the bottom of the first recess of the cap holder and the bottom of the second recess of the cap.

In this case, it is possible to purge outside the liquid absorbed in the absorber, by the negative pressure, via the suction hole.

In the cap apparatus of the present invention, a diameter of the first through hole may be smaller than a diameter of the second through hole and a diameter of the third through hole; and a diameter of the pin may be smaller than those of the second and the third through holes, and may be larger than that of the first through hole. In this case, since it is possible to insert the pin easily into the second through hole and the third through hole, but not possible to insert the pin into the first through hole, there is no possibility of the pin getting too deep inside, and it is possible to fix easily the engaging portion to the first through hole.

In the cap apparatus of the present invention, the projecting portion may have two triangular-pillar shaped projections extended in the predetermined direction; the two projections may be arranged at a predetermined interval; and a through hole which guides the liquid to the absorber may be formed between the two projections of the projecting portion. In this case, it is possible to guide easily even the liquid flowed to the inner side of the two projections to the absorber.

In the cap apparatus of the present invention, plurality of projections may be arranged at predetermined intervals, and the through hole formed in the plate member may be formed as a plurality of communicating holes arranged along the predetermined direction, and arranged between the projections and on both sides of the projection respectively. In this case, it is possible to guide easily the liquid run down along any of the projections, to the absorber.

In the cap apparatus of the present invention, each of the communicating holes may be formed as a slit extending in the predetermined direction, and each of the communicating holes may be formed as a plurality of communicating-hole rows each extending in the predetermined direction; and each of the communicating-hole rows may be arranged along a direction orthogonal to the predetermined direction. In any of the cases, it is possible to guide easily the liquid run down along the projection, to the absorber assuredly.

According to a second aspect of the present invention, there is provided a liquid jetting apparatus which jets a liquid, including:

a liquid jetting head having a nozzle surface in which a plurality of nozzles jetting a liquid is formed, a cap apparatus covering a nozzle surface of the liquid jetting head and including: a cap holder which includes a first recess formed therein, and a first through hole formed in a bottom of the first recess; a cap which is accommodated tightly inside the first recess to seal the nozzle surface, which is formed by an elastic member having a second recess formed therein, and which has a second through hole communicating with the first through hole and formed in a bottom of the second recess; an absorber which is accommodated tightly inside the second recess of the cap to absorb the liquid, and which includes a third through hole communicating with the first through hole and the second through hole and formed to penetrate through a lower surface up to an upper surface of the absorber, the lower surface facing the bottom of the second recess; and a holding member which holds the absorber and the cap and which has a contacting portion which makes a contact with the upper surface of the absorber, a pin which protrudes from the holding portion, and an engaging portion which is provided on a front end of the pin; and a suction unit which generates a negative pressure.

The pin is inserted through the second through hole and the third through hole, the engaging portion is engaged with the first through hole, and the absorber and the cap are clamped between the contacting portion and the cap holder.

A suction hole which propagates the negative pressure to a space which is sealed by the liquid jetting head and the cap body is formed penetrating through the bottom of the first recess of the cap holder and the bottom of the second recess of the cap body.

The suction unit is connected to the suction hole.

According to the second aspect of the present invention, the insertion resistance at the time of accommodating the cap in the cap holder is reduced substantially, and the assembling workability is improved. Moreover, since the liquid jetting apparatus has the suction unit which generates the negative pressure, it is possible to suck efficiently the unnecessary liquid. At this time, since the cap apparatus has the absorber, it is possible to absorb assuredly the liquid sucked in the cap.

DETAILED DESCRIPTION OF THE PREFERRED EMBODIMENTS

Exemplary embodiments of the present invention will be described below by referring to the accompanying diagrams.

First Embodiment

Figure 1:
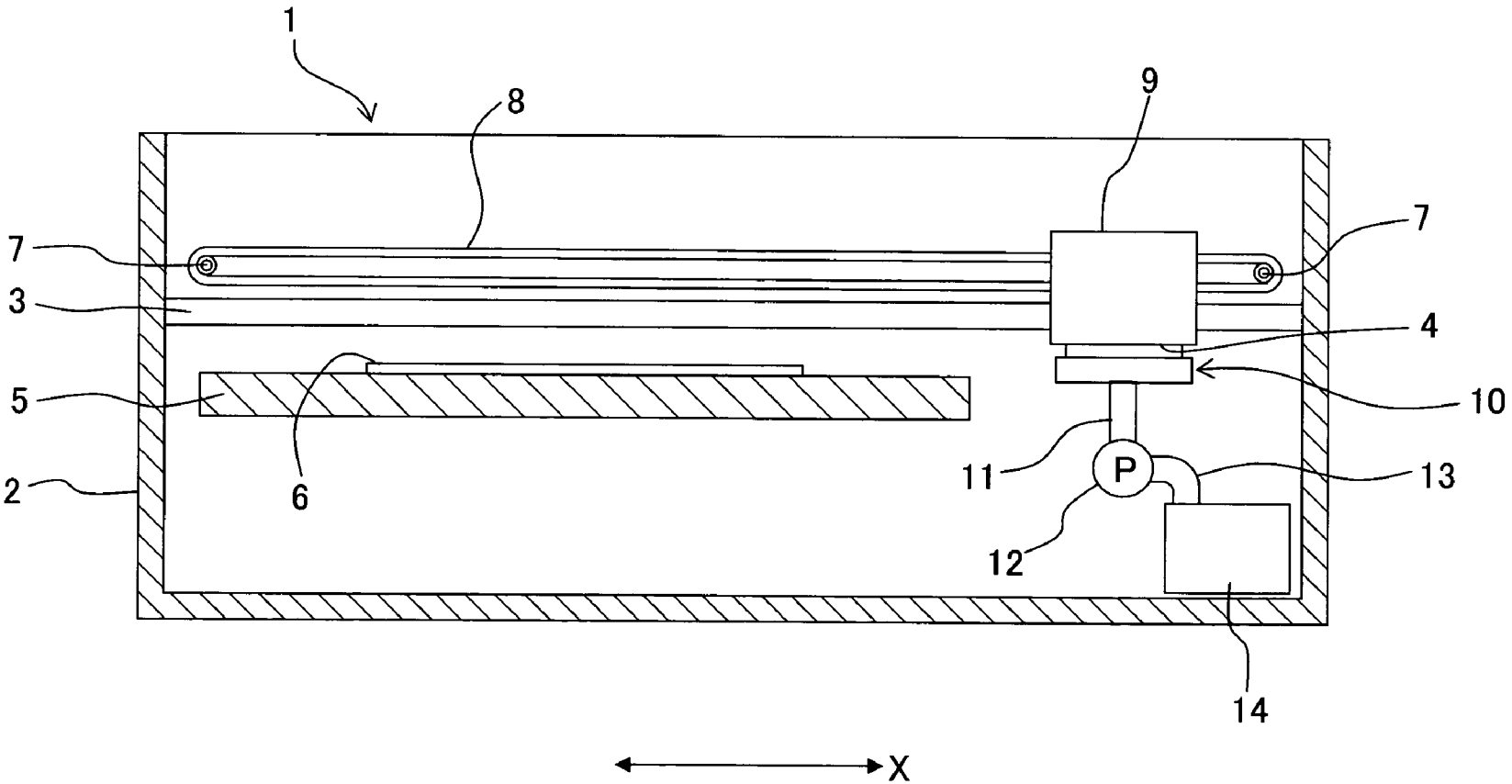
FIG. 1 is a schematic cross-sectional view of an ink-jet printer according to a first embodiment of the present invention.

FIG. 1 is a schematic cross-sectional view of an ink-jet printer (liquid jetting apparatus) according to a first embodiment of the present invention. As shown in FIG. 1, the ink-jet printer 1 includes a guide rod 3 which is installed in a casing 2, and a carriage 9 is slidably supported on the guide rod 3. An ink-jet head 4 (liquid jetting head) is provided on a bottom portion of the carriage 9, such that a nozzle surface 4*a* in which a nozzle hole 4*b* is formed is exposed downward (refer to FIG. 6). Moreover, a platen 5 is arranged on a lower side of the carriage 9, and a recording body 6 (such as a paper) is transported on the platen 5 by a paper feeding mechanism (not shown in the diagram), and an ink is jetted toward the recording body 6 from the ink-jet head 4. The carriage 9 is joined to a timing belt 8 which is put around a pair of pulleys 7, and the timing belt 8 is arranged parallel to an axial direction of the guide rod 3. A motor (not shown in the diagram) which drives the pulley 7 in a normal (positive) direction and a reverse direction is provided on one of the pulleys 7. The timing belt 8 reciprocates due to the rotation of the pulley 7 in the normal and the reverse direction, and the ink-jet head 4 is scanned in a left and right direction (X direction) along the guide rod 3. In the following description, a side which jets the ink is let to be a lower surface and a downward direction, and an opposite side is let to be an upper surface and an upward direction, and the scanning direction (X direction) of the carriage 9 in FIG. 1 is let to be left and right direction.

Moreover, a black ink tank and color ink tanks (for inks of colors such as yellow, magenta, and cyan) which are not shown in the diagram are connected to the ink-jet head 4. A cap apparatus 10 is provided to be capable of ascending and descending, at a lower side of the guide rod 3, in a non-printing area on one side in the left and right direction in the casing 2. A switching valve which is not shown in the diagram, and a suction pump (suction unit) 12 via a first tube 11 are connected to the cap apparatus 10, and the suction pump 12 is connected to a waste-liquid tank 14 via a second tube 13.

At the time of carrying out a purge operation of the ink-jet head 4, with the ink-jet head 4 moved up to an upper position of the cap apparatus 10, the cap apparatus 10 is ascended by an ascending and descending mechanism (a lifting mechanism) which is not shown in the diagram, and seals the nozzle surface 4*a* of the ink-jet head 4. Further, the switching valve is switched to a position at which the cap apparatus 10 and the suction pump 12 communicate, and the suction pump 12 is driven with the nozzle surface 4*a* in a state of being sealed by the cap apparatus 10. Then the air bubbles and the thickened ink are sucked into the ink-jet head 4 via the cap apparatus 10. Moreover, when the ink-jet head 4 does not carry out the purge operation or when the nozzle hole 4*b* is preserved (maintained) in a non-printing state, the switching valve is positioned at a position at which both the cap apparatus 10 and the suction pump 12 do not communicate with an outside, and the cap apparatus 10 is brought into contact with the nozzle surface 4*a*, and the inside of the cap is let to be a sealed space. In other words, the nozzle surface 4*a* of the ink-jet head 4 is sealed by the cap to preserve the nozzle hole 4*b* in good state, the cap cutting off from the atmosphere to prevent the ink in the ink-jet head 4 from drying.

Moreover, although it is not shown in the diagram, a known wiper which carries out cleaning by wiping the ink adhered to the nozzle surface 4*a* after the purge operation is arranged on a side of the cap apparatus 10, and furthermore, in a non-printing area at the other end of the casing 2 in the left and right direction, a flushing receiver which is not shown in the diagram is arranged, and a defect in ink jetting is recovered by jetting the ink, periodically or forcibly, from the nozzle hole 4*b* of the ink-jet head 4.

Figure 6:
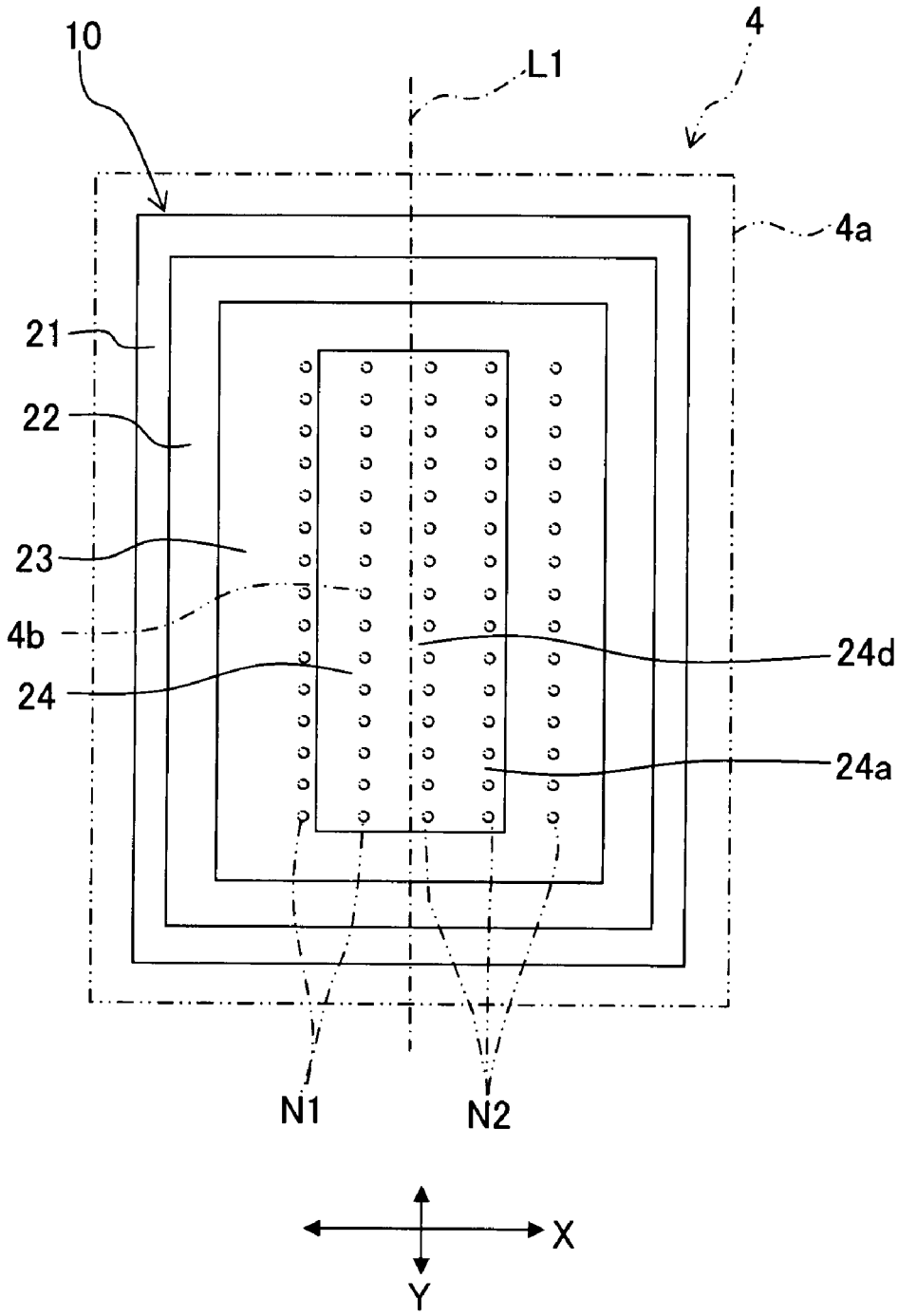
FIG. 6 is a plan view indicating a positional relationship of the cap apparatus of the ink-jet printer shown in FIG. 1, and nozzle rows of an ink-jet head.

The ink-jet head 4, as described in Japanese Patent Application Laid-open No. 2005-322850 and Japanese Patent Application Laid-open No. 2005-313428, is a stacked body in which a cavity unit (not shown in the diagram) and a piezoelectric actuator (not shown in the diagram) are attached. The cavity unit is formed by stacking and adhering a plurality of plates, and the ink is supplied to the cavity unit from each ink tank. The piezoelectric actuator is in the form of a plate and has a plurality of piezoelectric deforming portions. A flexible wiring material on which a driving circuit is mounted (both not shown in the diagram) is arranged on an upper surface of the piezoelectric actuator, and are mutually connected electrically. On the lowermost nozzle surface of the cavity unit, as shown in FIG. 6, the plurality of nozzle holes 4*b* which jet ink of each color form nozzle rows in Y direction, and a plurality of rows is provided in the scanning direction (X direction) of the carriage 9. Moreover, by deforming selectively the piezoelectric deforming portions by a printing signal from the driving circuit, the ink is jetted from the corresponding nozzle holes 4*b*.

Figure 2:
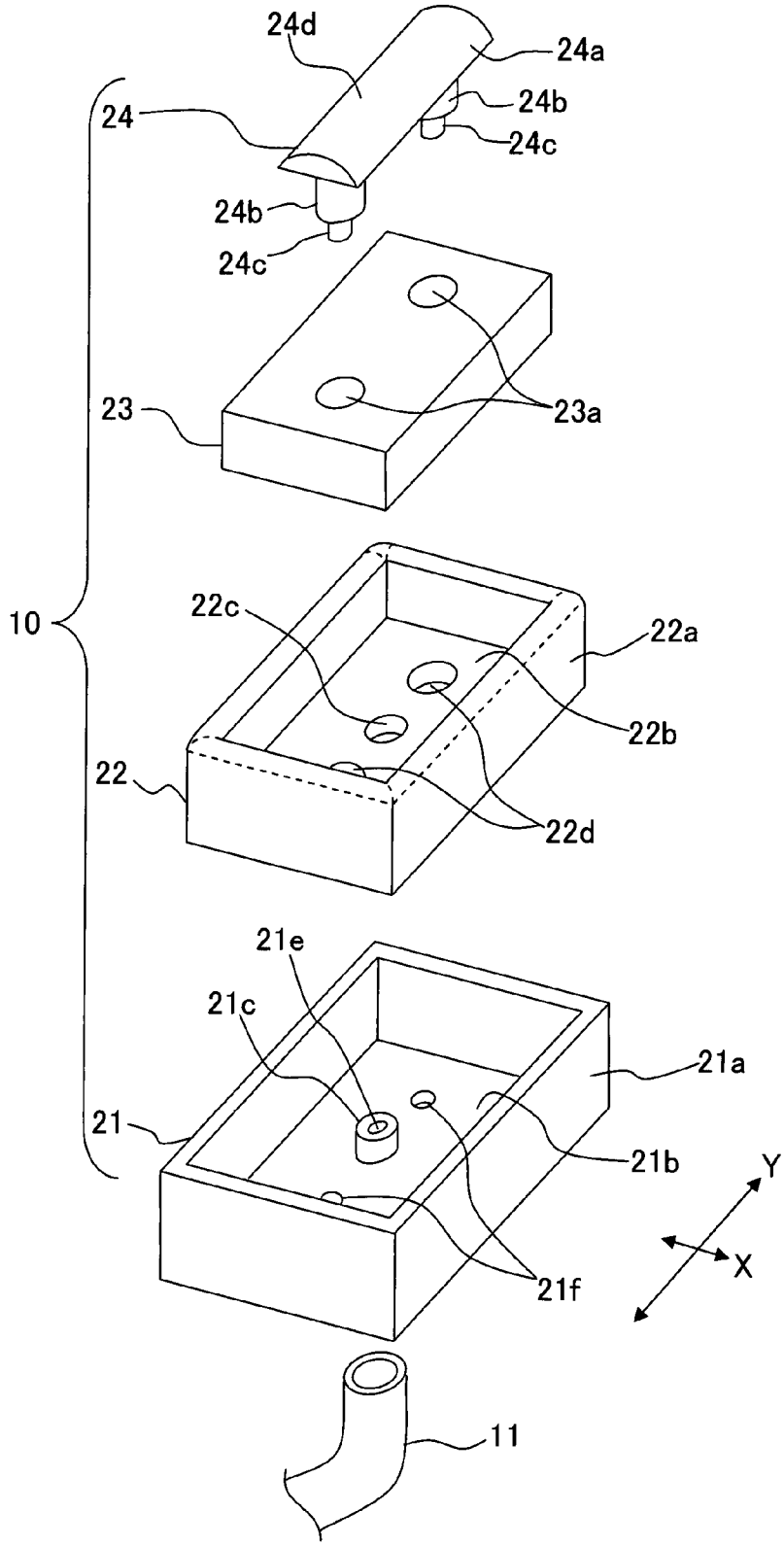
FIG. 2 is an exploded perspective view of a cap apparatus of the ink-jet printer shown in FIG. 1.

FIG. 2 is an exploded perspective view of the cap apparatus 10 of the ink-jet printer 1 shown in FIG. 1. As shown in FIG. 2, the cap apparatus 10 has a cap (cap body) 33 which covers the nozzle surface 4*a* of the ink-jet head 4 is accommodated tightly (firmly) inside a cap holder 21, and further, the cap 22 includes an absorber 23 which absorbs the purged ink, and a holder 24 which holds the absorber 23 from the upper side thereof, and fixes to the cap holder 21. The cap apparatus 10 is connected to a first tube 11 which is connected to the suction pump 12. The cap 22 is made of an elastic material (such as rubber), and the cap holder 21 is made of a resin material (such as polypropylene) which is harder than the cap 22. Moreover, the absorber 23 is made of a porous material (such as urethane and sponge, or pulp) or a high-molecular absorbing material, and the holder 24 is made of a resin material (such as polypropylene).

The cap holder 21 has a recess shaped in a cross-section and accommodates tightly the cap 22, and a bottom-wall 21*b* of the cap holder 21 has a rectangular shape longer in a row direction (Y direction. Refer to FIG. 6) of the nozzle holes 4*b*, and a surrounding-wall 21*a* is protruded upward from a circumference of the bottom-wall 21*b*. An upper projecting portion 21*c* which is projected upward from a central portion of the bottom-wall 21*b*, and a lower projecting portion 21*d* (refer to FIG. 5) which is projected downward at a position corresponding to the upper projecting portion 21*c* are provided to the bottom-wall 21*b*. The upper projecting portion 21*c* and the lower projecting portion 21*d* are provided with a suction hole 21*e* which is cut through in the up-down direction. Moreover, a pair of engaging holes 21*f* are formed as through holes in the bottom-wall 21*b* at areas of both sides of the upper projecting portion 21*c* in a longitudinal direction (Y direction).

The cap 22 which covers the nozzle surface 4*a* has recess shaped in the cross-section, and in the rectangular bottom-wall 22*b* which is longer in the nozzle-row direction (direction of the nozzle row) (Y direction) in a plan view, a through hole 22*c*, corresponding to the upper projecting portion 21*c* of the cap holder 21, through which the upper projecting portion 21*c* of the cap holder 21 is inserted, is formed. Moreover, in the bottom-wall 22*b*, a pair of inserting holes 22*d* which communicate with the engaging holes 21*f* of the cap holder 21 is provided on both sides in the Y direction of the through hole 22*c*, and a diameter of the inserting hole 22*d* is larger than a diameter of the engaging hole 21*f*. The cap 22 has a surrounding-wall 22*a* which is protruded upward from a circumference of the bottom-wall 22*b*. An outer surface of the surrounding-wall 22*a* and the bottom-wall 22*b* is accommodated tightly (closely) along an inner surface of the surrounding-wall 21 and the bottom-wall 21*b* of the cap holder 21. An upper surface of the bottom-wall 22*b* of the cap 22 and an upper end surface of the upper projecting portion 21*c* of the cap holder 21 are arranged on the same plane. Moreover, an upper end of the surrounding-wall 22*a* is projected upward, above the surrounding-wall 21*a* of the cap holder 21. Furthermore, the upper end of the surrounding-wall 22*a* is circular arc shaped (rounded shaped). In other words, for making it easy to make airtight the inside of the cap 21 by sealing the nozzle surface 4*a* at the time of purge operation, it is desirable to make a thickness of the upper end of the surrounding-wall 22*a* to be gradually thin toward the upper end, and to make a shape which is easily flattened (deformed).

The absorber 23 is a rectangular parallelepiped member having a rectangular shape in a plan view which is accommodated tightly inside the cap 22. A pair of inserting holes 23*a* which communicate with the inserting holes 22*d* of the cap is cut through the absorber 23. These inserting holes 23*a* have same diameter as of each of the inserting holes 22*d* in the cap. An upper surface of the absorber 23 is pressed against an upper surface of a holding body 24*a* of the holder 24, and the absorber 23 is suppressed from being lifted up by swelling due to absorbing the ink. An upper surface of the holding body 24*a* which will be described later, and the upper surface of the absorber 23 are arranged to be lower than the upper end of the surrounding-wall 22*a* of the cap 22. Moreover, although the absorber 23 in the first embodiment is one-layered, it is not limited to be one-layered provided that the absorber 23 is accommodated inside the cap 22, and a plurality of absorbers each of which has an independent density and/or absorbing capacity may be arranged according to an object. Moreover, for expediting the flow of ink not only to the absorber 23, but also to the suction hole 21*e*, an ink infusing plate having a shape which is capable of generating a capillarity may be stacked.

The holder 24 has the holding body 24*a* which makes a contact with the upper surface of the absorber 23, a pair of pins 24*b* which are protruded downward from a lower surface of the holding body 24*a*, and an engaging portion 24*c* which is provided at a front end (lower end) of each pin 24*b*. The holding body 24*a* is extended in a direction (Y direction) in which the rows of the nozzle holes 4*b* are extended, in other words, in a longitudinal direction of the absorber 23. The holding body 24*a* has a circular arc shaped upper surface and a flat lower surface, the upper surface having a central portion which is projected upward in a cross-sectional view, that is, as viewed in a direction orthogonal to the extending direction. In other words, a central portion in the cross-sectional view (X direction) orthogonal to the direction of extension (Y direction) of the holding body 24*a* is a projecting portion 24*d*. Each of the pins 24*b* has an outer diameter such that the pin 24*b* is inserted closely through each of the inserting holes 22*d* and 23*a* of the cap 22 and the absorber 23. The engaging portion 24*c* is a projecting portion which is projected downward from a lower end of the pin 24*b*. The engaging portion 24*c* has a diameter smaller than the diameter of the pin 24*b*, and has an outer diameter which is press-fitted into the engaging hole 21*f* of the cap holder 21.

Figure 3:
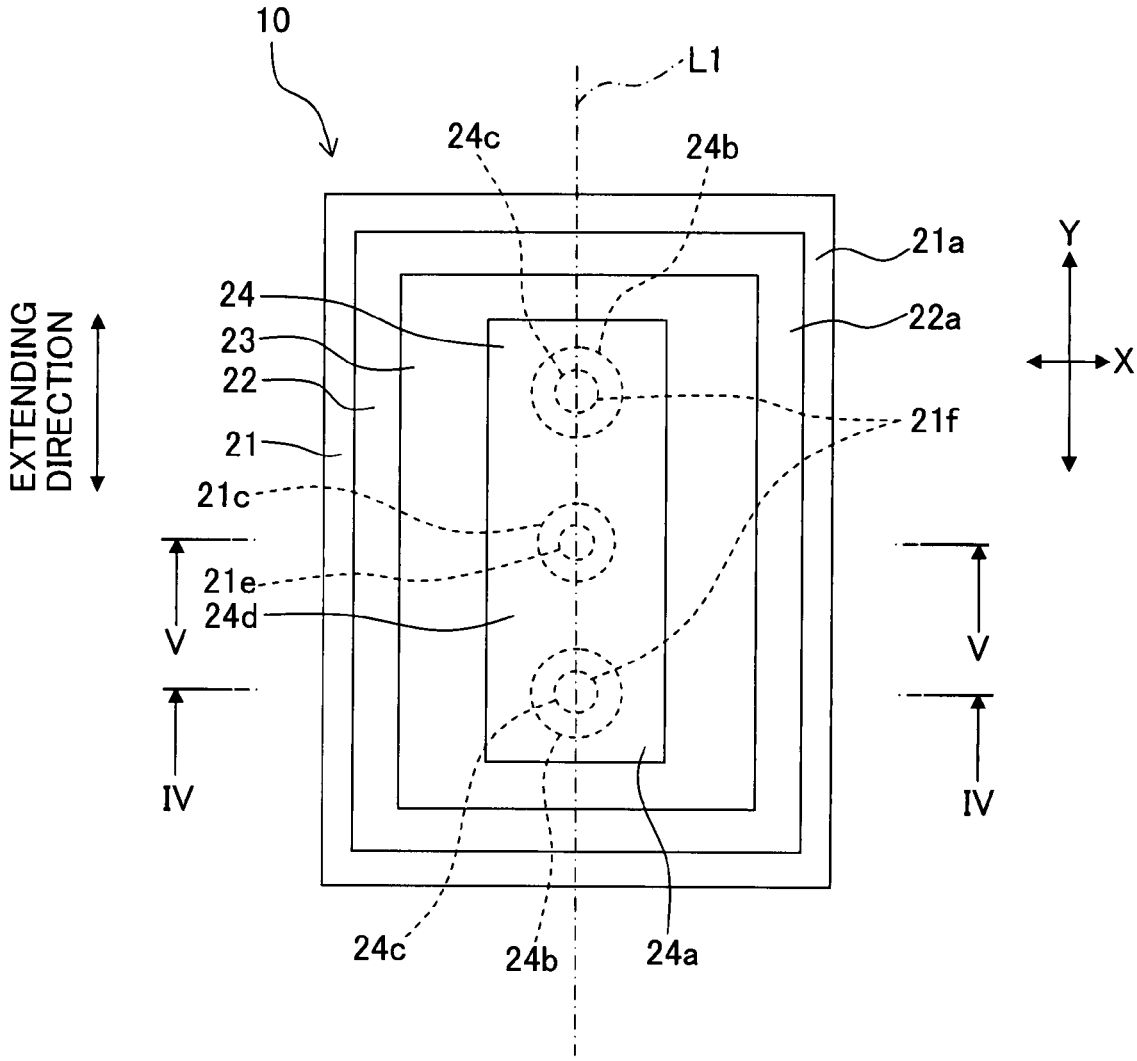
FIG. 3 is a plan view of the cap apparatus of the ink-jet printer shown in FIG. 1.
Figure 4:
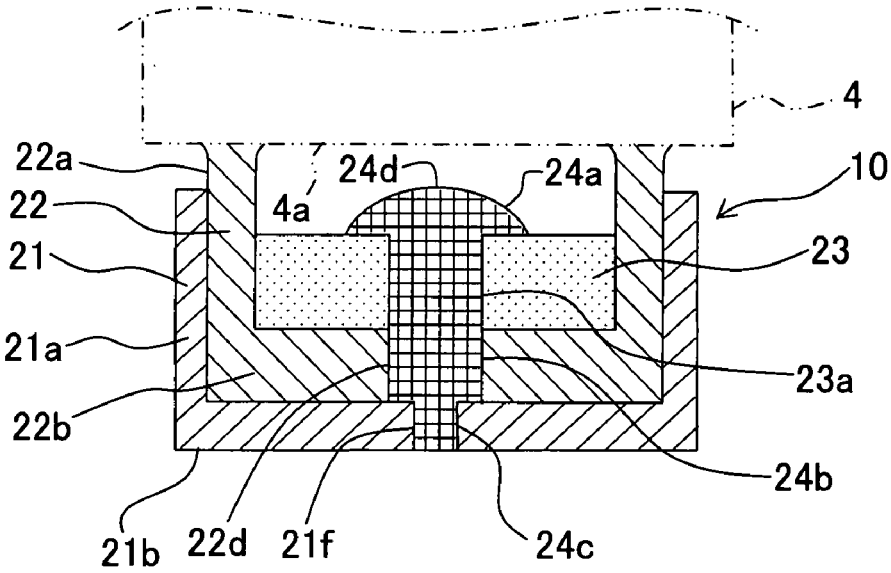
FIG. 4 is a cross-sectional view taken along a line IV-IV in FIG. 3.
Figure 5:
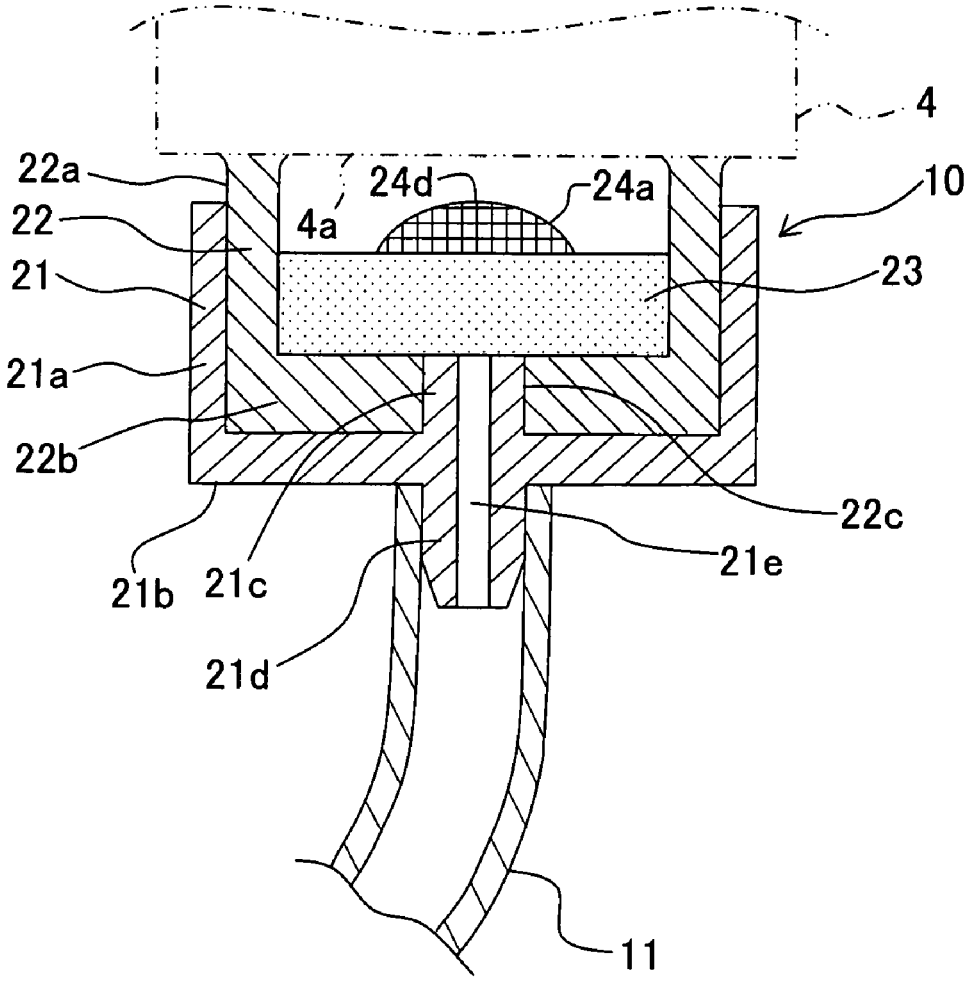
FIG. 5 is a cross-sectional view taken along a line V-V in FIG. 3.

FIG. 3 is a plan view of the cap apparatus 10 of the ink-jet printer 1 shown in FIG. 1. FIG. 4 is a cross-sectional view taken along a line IV-IV in FIG. 3. FIG. 5 is a cross-sectional view taken along a line V-V in FIG. 3. As shown in FIG. 3, a width of the holding body 24*a* in a direction (X direction) orthogonal to the extending direction, is formed to be smaller than a width of the absorber 23 such that the absorption of the ink is not hindered. Moreover, the pins 24*b* of the holder 24 are inserted downward (from top to bottom) through the inserting holes 22*d* and 23*a* respectively, and the engaging portion 24*c* is engaged by press-fitting into the engaging hole 21*f*. Accordingly, the cap 22 and the absorber are clamped between the lower surface of the holding body 24*a* and the bottom-wall 21*b* of the cap holder 21.

As shown in FIG. 5, an upper surface of the bottom-wall 22*b* of the cap 22, and an upper end surface of the upper projecting portion 21*c* of the cap holder 21 are formed on the same plane, and these surfaces make a close contact with the lower surface of the absorber 23. Moreover, the first tube 11 is installed by fitting into the lower projecting portion 21*d* of the cap holder 21. Furthermore, an upper end of the surrounding-wall 22*a* of the cap 22 is pressure welded from a lower side to the nozzle surface 4*a* of the ink-jet head 4 by an ascending and descending mechanism, and the nozzle surface 4*a* is sealed. A negative pressure in the first tube 11 is propagated to the absorber 23 via the suction hole 21*e*, and a space inside the cap 22 is let to be at the negative pressure, and the ink is sucked from the nozzle hole 4*b*.

FIG. 6 is a plan view indicating a positional relationship of the cap apparatus 10 of the ink-jet printer 1 shown in FIG. 1, and nozzle rows N1 and N2 of the ink-jet head 4. As shown in FIG. 6, the nozzle surface 4*a* of the ink-jet head 4 is provided with nozzle rows N1 in which nozzles 4*b* which jet a black ink are arranged in two rows in an extending direction of the holder 24, and nozzle rows N2 in which nozzles 4*b* for jetting color inks (of colors such as yellow, magenta, and cyan) are arranged in three rows in the extending direction of the holder 24 (Y direction). The projecting portion 24*d* of the holding body 24*a* is arranged to be extended so as to divide the nozzle rows N1 for the black ink from the nozzle rows N2 for the color inks. In other words, a virtual vertical-plane (or a virtual vertical-line) which includes a line L1 which passes through a top of the circular arc of the holding body 24*a*, is positioned between the nozzle rows N1 and the nozzle rows N2 such that the nozzle rows N1 for the black ink and the nozzle rows N2 for the color inks are divided.

Since the engaging hole 21*f* is formed in the bottom-wall 21*b* of the cap holder 21, even when the cross-sectional recess shaped cap 22 is inserted into the cross-sectional recess shaped cap holder 21 while making a close contact, at the time of assembling the cap apparatus 10, air in a space formed between the bottom-wall 22*b* of the cap 22 and the bottom-wall 21*b* of the cap holder 21 is discharged through the engaging hole 21*f*. In other words, since the engaging hole 21*f* also serves as an air-vent hole, a person who assembles the cap apparatus, is not required to force the cap 22 into the cap holder 21, while avoiding a close contact with the cap holder 21 by bending the surrounding-wall 22*a* of the cap 22, and workability of assembling the cap apparatus 10 is improved substantially.

Moreover, since the engaging portion 24*c* of the holder 24 has a simple structure such as a projecting portion, it is possible to manufacture easily, and since the engaging portion 24*c* is press-fitted into the engaging hole 21*f*, it is possible to prevent the holder 24 from being lifted up by swelling of the absorber due to absorbing of the ink. Furthermore, since the holding body 24*a* has the projecting portion 24*d* which is projected upward to correspond with the position which divides the nozzle rows N1 for the black ink and the nozzle rows N2 for the color inks, the ink is guided according to the type of the ink, to the absorber upon being divided (distributed) to both sides of the projecting portion 24*d*. Consequently, mixing of the inks of different type is suppressed.

Particularly, when the black ink is a pigment ink and the color ink is a dye ink, since the pigment-based black ink and the dye-based color ink tend to be hardened due to mixing; by making such an arrangement, it is possible to suppress an affect on the nozzle surface 4*a*. Moreover, since the projecting portion 24*d* of the holder 24 is circular arc shaped, and the ink which is sucked along the circular arc is guided to the absorber 23, it is possible to suppress the mixing of colors.

An arrangement of the nozzle holes 4*b* can be arbitrary, but taking into consideration an effect of the subsequent jetting after the purge, it is desirable that the nozzle rows for the black ink are separated from the nozzle rows for light color ink (such as yellow and light color ink).

Furthermore, although the suction hole 21*e*, the upper projecting portion 21*c*, the lower projecting portion 21*d*, and through holes 22*c* formed to correspond to the lower projection portion 21*d*, are formed at a central portion of each of the bottom-walls 21*b* and 22*b*, they are not required necessarily to be at the center, provided that the ink flow is not hindered. Therefore, these can be arranged appropriately except for positions at which the engaging hole 21*f* and the inserting hole 23*f* are provided.

Second Embodiment

Figure 7A:
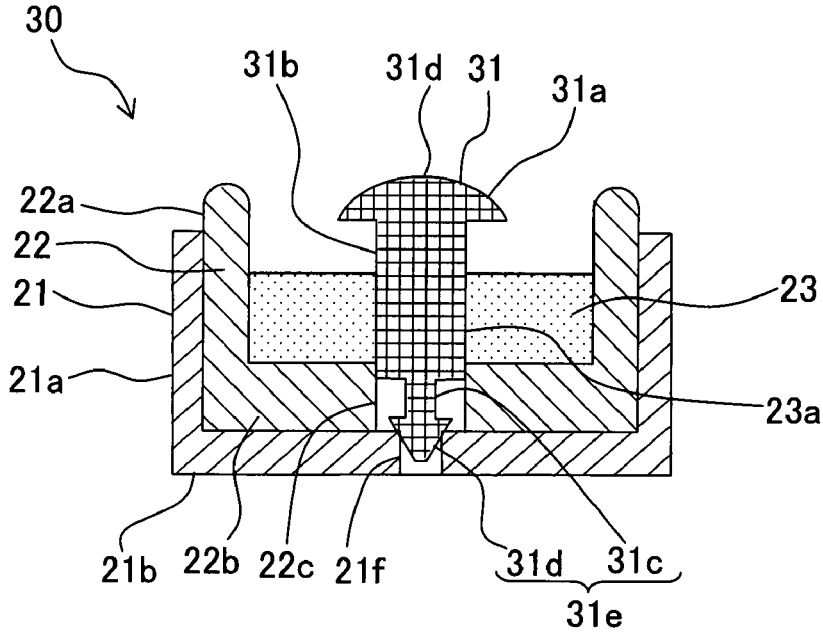
FIG. 7A is a cross-sectional view before fixing a holder of a cap apparatus according to a second embodiment.
Figure 7B:
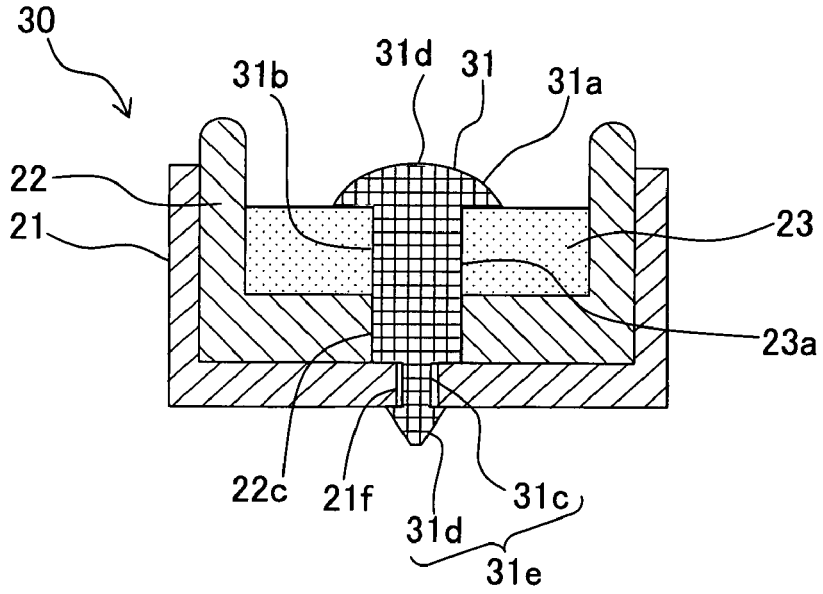
FIG. 7B is a cross-sectional view after fixing the holder of the cap apparatus according to the second embodiment.

Next, a second embodiment of the present invention will be described below. FIG. 7A is a cross-sectional view showing the state before fixing a holder 31 of a cap apparatus 30 according to the second embodiment, and FIG. 7B is a cross-sectional view after fixing the holder 31. Since a structure of the cap apparatus 30, except for the holder 31, is similar as the structure of the cap apparatus 10 in the first embodiment, same reference numerals are assigned to the components same as in the first embodiment, and detailed description of these components is omitted. As shown in FIG. 7A, the holder 31 has a holding body 31*a* which has a cross-sectional arc shaped projecting portion 31*d*, in contact with an upper surface of the absorber 23, a pin 31*b* which is protruded downward from the holding body 31*a*, and an engaging portion 31*e* having an arrowhead shape, which is provided at a lower end of the pin 31*b*. Specifically, the engaging portion 31*e* has a shaft portion 31*c* having a diameter smaller than a diameter of the pin projected from the lower end of the pin 31*b*, and a latching portion 31*d* having a tapering shape, which is provided at a lower end of the shaft portion 31*c*, and has a maximum outer diameter larger than an outer diameter of the shaft portion 31*c*. The holding body 31*a* and the pin 31*b* are similar as in the first embodiment.

As shown in FIG. 7A, the pin 31*b* of the holder 31 is downwardly inserted into each of the inserting holes 22*d* of the cap 22 and inserting holes 23*a* of the absorber 23 respectively, such that the latching portion 31*d* of the engaging portion 31*e* makes a contact with a peripheral border of an upper surface side of the engaging hole 21*f*. Then a person who assembles, pushes the holder 31 downward, the latching portion 31*d* of the holder 31 is latched at the peripheral border of the upper surface side of the engaging hole 21*f* of the cap holder 21. Accordingly, the cap 22 and the absorber 23 are clamped between the holding body 31*a* and the bottom-wall 21*b* of the cap holder 21.

As described above, since the engaging portion 31*c* of the holder 31 has the latching portion 31*d*, and the latching portion 31*d* is latched at the peripheral border of the lower surface side of the engaging hole 21*f*, it is possible to prevent assuredly the holder 31 from being lifted up due to swelling of the absorber 23 upon absorbing ink.

Third Embodiment

Figure 8:
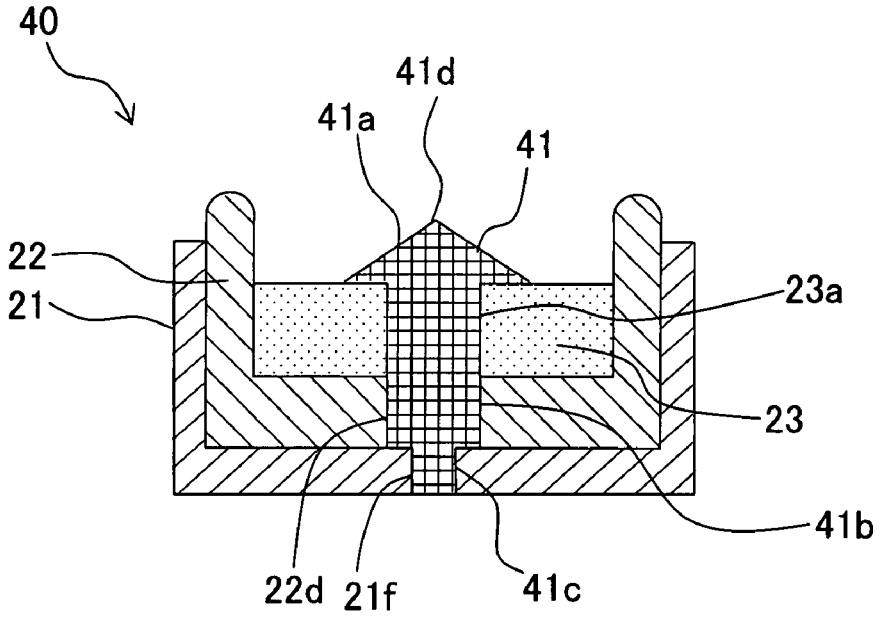
FIG. 8 is a cross-sectional view of a cap apparatus according to a third embodiment of the present invention.
Figure 9:
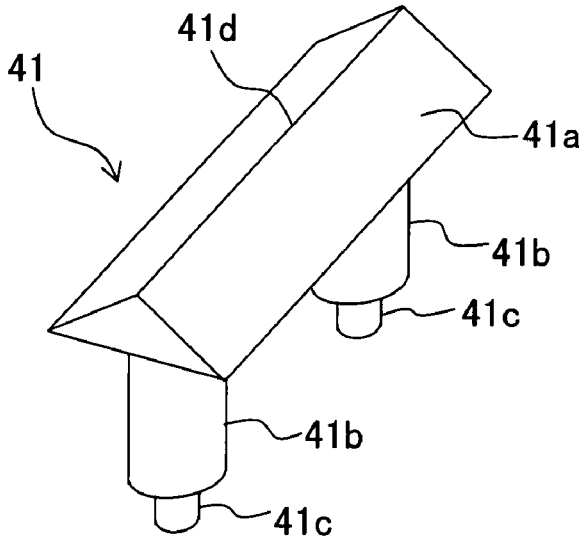
FIG. 9 is a perspective view of a holder of the cap apparatus shown in FIG. 8.

Next, a third embodiment of the present invention will be described below. FIG. 8 is a cross-sectional view of a cap apparatus 40 according to the third embodiment. FIG. 9 is a perspective view of a holder 41 of the cap apparatus 40 shown in FIG. 8. Since a structure of the cap apparatus 40, except for the holder 41 is similar as the structure of the cap apparatus 10 in the first embodiment, same reference numerals are assigned to the components same as in the first embodiment, and detailed description of these components is omitted. As shown in FIG. 8 and FIG. 9, the holder 41 has a holding body 41*a* which makes a contact with the upper surface of the absorber 23, a pair of pins 41*b* which are projected downward from the holding body 41*a*, and an engaging portion 41*c* which is provided on a lower end of each pin 41*b*. The holding body 41*a* is extended in a longitudinal direction of the absorber 23, and has a triangular upper surface of which a central portion is projected upward in a cross-sectional view orthogonal to the extending direction. In other words, a central portion of the holding body 41*a* in the cross-sectional view orthogonal to the extending direction is a projecting portion 41*d*. The pin 41*b* and the engaging portion 41*c* are same as in the first embodiment.

As described above, since the projecting portion 41*d* of the holding body 41*a* has a cross-sectional triangular shape, it is possible to guide the ink jetted from the ink-jet head to the absorber 23 by making the ink flow smoothly along a slope of the projecting portion 41*d*.

Fourth Embodiment

Figure 10:
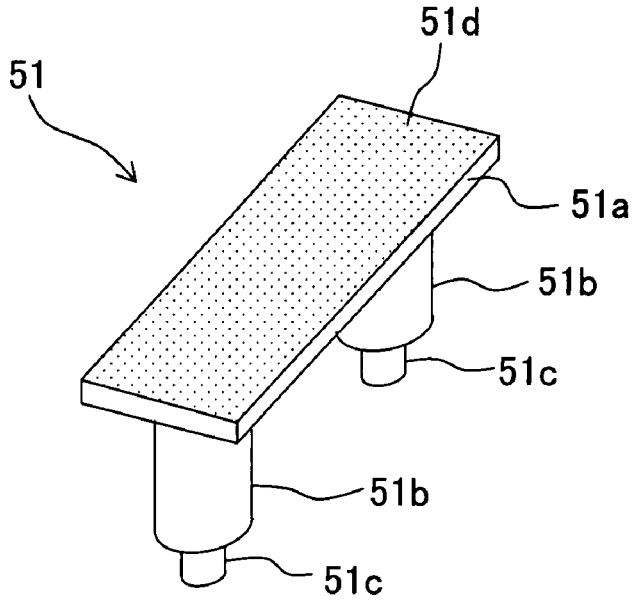
FIG. 10 is a perspective view of a holder of a cap apparatus according to a fourth embodiment.

Next, a fourth embodiment of the present invention will be described below. FIG. 10 is a perspective view of a holder 51 of a cap apparatus according to the fourth embodiment. Since a structure of the cap apparatus except for the holder 51 is similar as the structure of the cap apparatus 10 in the first embodiment, detailed description is omitted. As shown in FIG. 10, the holder 51 of the fourth embodiment has a holding body 51*a* in the form of a flat plate, a pair of pins 51*b* which are protruded downward from the holding body 51*a*, and an engaging portion 51*c* which is a projecting portion provided at a lower end of each pin 51*b*. An area of the holding body 51*a* which holds the absorber 23 (refer to FIG. 3) is same as an area of the holding body 24*a* in the first embodiment (refer to FIG. 3). A water repellent layer 51*d* is provided by a fluorine coating for example, on an upper surface of the holding body 51*a*.

As described above, even when the holding body 51*a* is in the form of a flat plate, the ink jetted from the ink-jet head 4 is repelled by the water repellent layer 51*d*, and is guided smoothly to the absorber 23. Therefore, it is possible to prevent appropriately, readhering of the ink to the head surface (nozzle surface) 4*a*. The water repellent layer 51*d* in the fourth embodiment is formed only on the upper surface of the holding body 51*a*. However, the water repellent layer 51*d* may be formed on a side end portion of the holding body 51*a*, and further may be formed on the entire surface of the holding body 51*a*. Moreover, a water repellent layer similar to the water repellent layer 51*d* may be applied to the holders of all the embodiments described in this specification. Moreover, a material of the holder may be formed by using a material such as a water repellent resin (such as fluororesin material).

Fifth Embodiment

Figure 11:
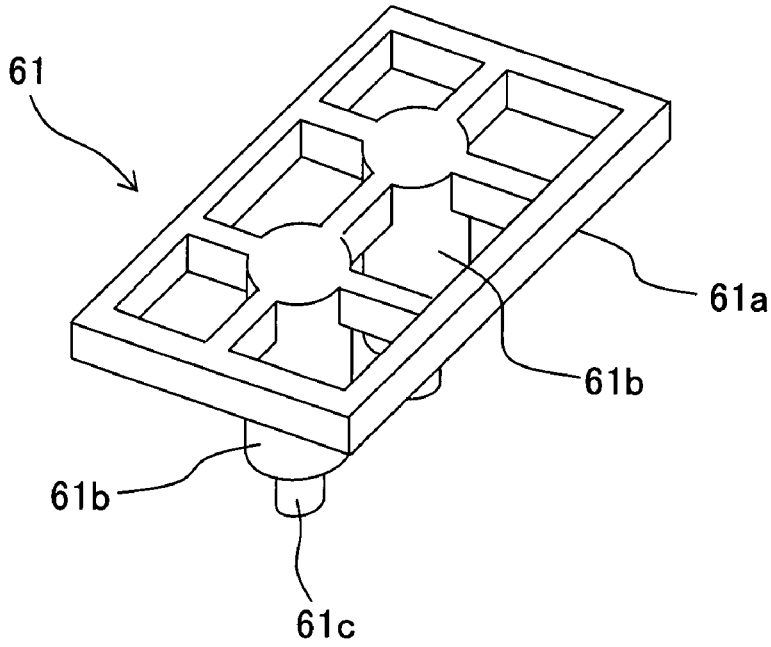
FIG. 11 is a perspective view of a holder of a cap apparatus according to a fifth embodiment.

Next, a fifth embodiment of the present invention will be described below. FIG. 11 is a perspective view of a holder 61 of a cap apparatus according to the fifth embodiment. Since a structure of the cap apparatus, except for the holder 61, is similar as the structure of the cap apparatus 10 in the first embodiment, description of the similar components is omitted. As shown in FIG. 11, the holder 61 of the fifth embodiment has a holding body 61*a* in the form of a grating, a pair of pins 61*b* which are projected downward from the holding body 61*a*, and an engaging portion 61*c* which is a projecting portion provided at a lower end of each pin 61*b*. A size of the holding body 61*a* is such that an outer frame of the holding body 61*a* is capable of holding a surrounding area on the upper surface of the absorber 23 so that the entire upper surface of the absorber 23 (refer to FIG. 3) is held.

As described above, since the holding body 61*a* is in the form of a grating, it is possible to guide the ink through the gap to the absorber 23, while holding the upper surface of the absorber 23 over a wide range. In other words, it is possible to have favorably both a holding capacity and the ink absorbing capacity of the absorber 23.

Sixth Embodiment

Figure 12:
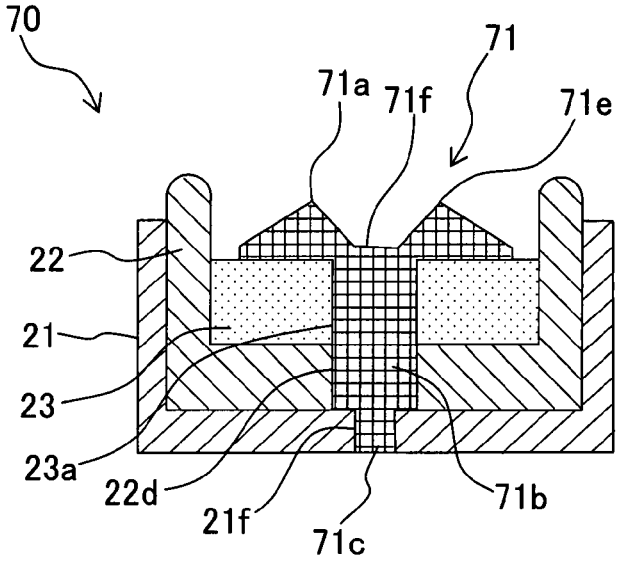
FIG. 12 is a cross-sectional view of a cap apparatus according to a sixth embodiment.
Figure 13:
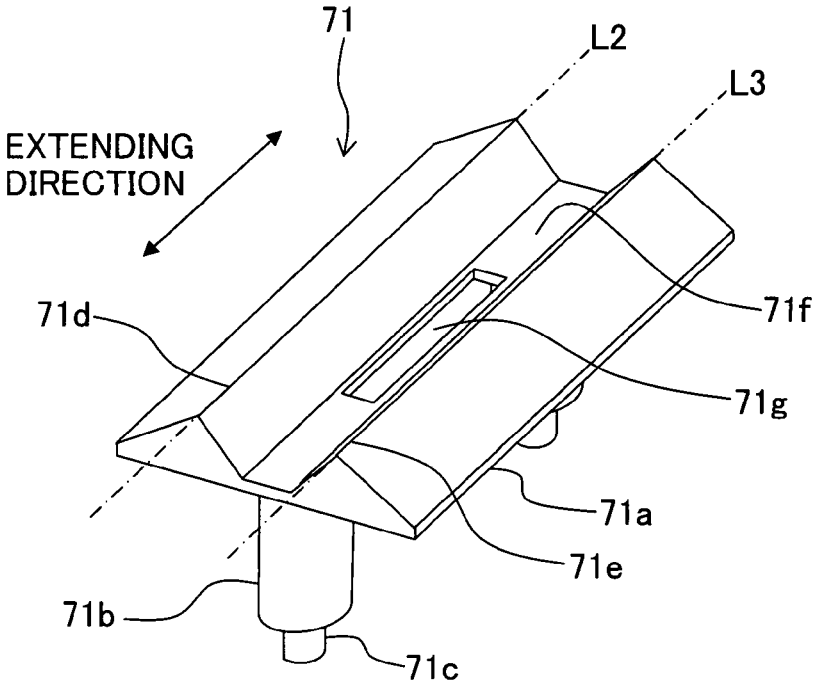
FIG. 13 is a perspective view of a holder of the cap apparatus shown in FIG. 12.

Next, a sixth embodiment of the present invention will be described below. FIG. 12 is a cross-sectional view of a cap apparatus 70 according to the sixth embodiment. FIG. 13 is a perspective view of a holder 71 of the cap apparatus 70 shown in FIG. 12. Since a structure of the cap apparatus 70, except for the holder 71 is similar as the structure of the cap apparatus 10 in the first embodiment, same reference numerals are assigned the same components in the following description, and detailed description of such components is omitted. As shown in FIG. 12 and FIG. 13, the holder 71 has a holding body 71*a* which makes a contact with the upper surface of the absorber 23, a pair of pins 71*b* which are protruded downward from the holding body 71*a*, and an engaging portion 71*c* which is provided at a lower end of each pin 71*b*. The pins 71*b* and the engaging portion 71*c* are similar as in the first embodiment.

The holding body 71*a* is extended in the longitudinal direction of the absorber 23, and has a first projecting portion 71*d* and a second projecting portion 71*e* respectively, on two sides in a direction orthogonal to the extending direction. Each of the first projecting portion 71*d* and the second projecting portion 71*e* is triangular in a cross-sectional view orthogonal to the direction of extension, with an apex thereof arranged along the extending direction. A plate portion 71*f* is provided continuously between the first projecting portion 71*d* and the second projecting portion 71*e*, and a through portion 71*g* which is cut through in a vertical direction and is extended in the extending direction, opens at a central portion (at a position not interfering with the pin 71*b*) of the plate portion 71*f*. Moreover, a width of the holding body 71*a*, in a direction orthogonal to the direction of extension is smaller than a width of the absorber 23. The first projecting portion 71*d* and the second projecting portion 71*e* may have a circular arc shaped upper surface as in the first embodiment.

Figure 14:
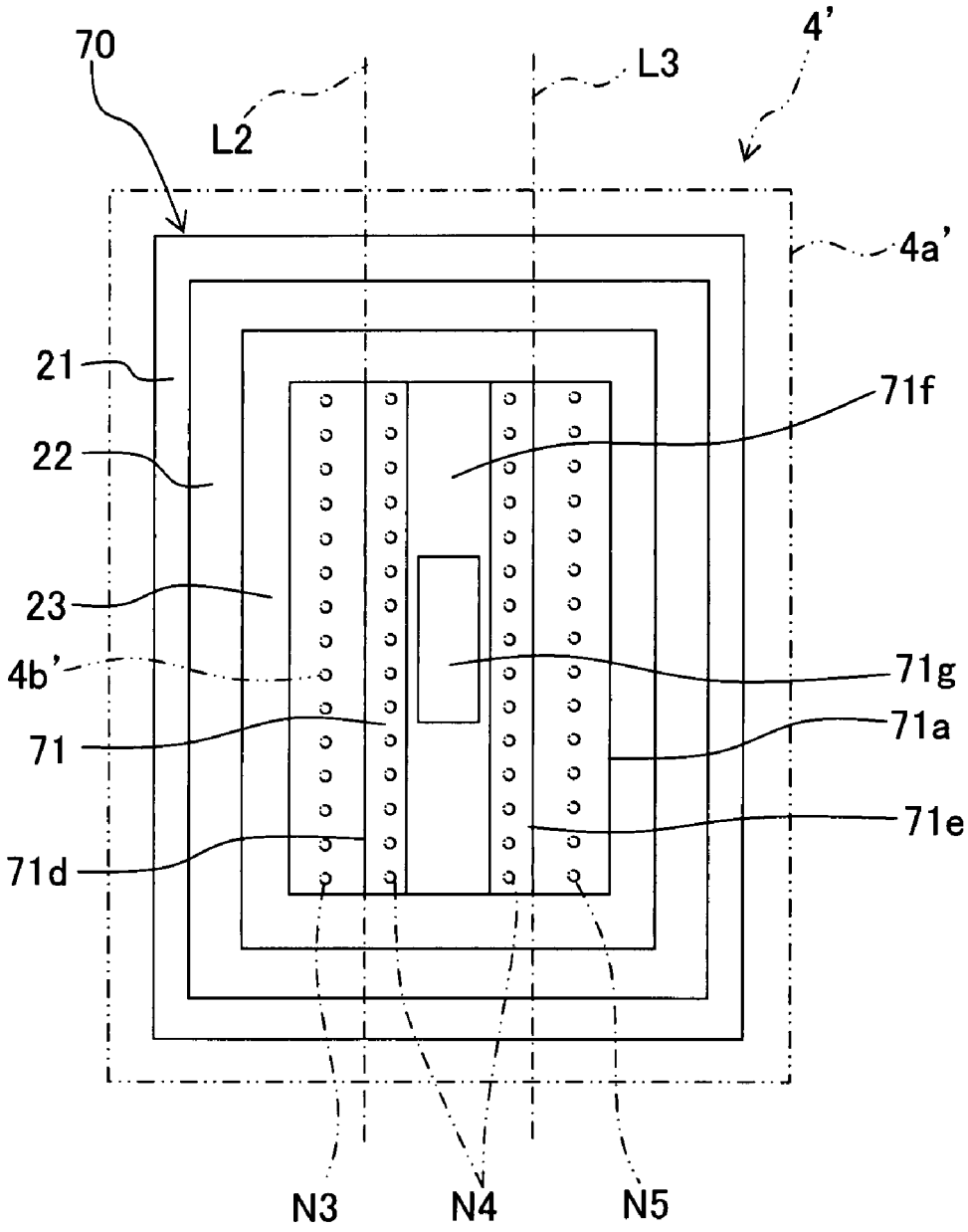
FIG. 14 is a plan view indicating a positional relationship of the cap apparatus shown in FIG. 12 and a nozzle row of the ink-jet head.

FIG. 14 is a plan view indicating a positional relationship of the cap apparatus 70 shown in FIG. 12, and nozzle rows N3, N4, and N5 of an ink-jet head 4'. As shown in FIG. 14, a nozzle surface 4*a'* of the ink-jet head 4' is provided with the nozzle row N3 in which nozzle holes 4*b'* which jet the black ink are arranged in a row, the nozzle rows N4 in which, nozzle holes 4*b'* which jet the color ink are arranged in two rows, and a nozzle row N5 in which, nozzle holes 4*b'* which jet other color ink are arranged in a row. The first projecting portion 71*d* of the holding body 71*a* is arranged to be extended corresponding to a position dividing the nozzle row N3 and the nozzle rows N4. In other words, the setting (structure) is such that a virtual plane (or a virtual line) which passes (crosses) in (through) vertical direction a line L2 which passes through an apex of the first projecting portion 71*d* is positioned between the nozzle row N3 and the nozzle row N4 such that the nozzle row N3 and the nozzle row N4 are divided. Similarly, the second projecting portion 71*e* of the holding body 71*a* is arranged to be extended corresponding to a position which divides the nozzle row N4 and the nozzle row N5. In other words, the setting (structure) is such that a virtual plane (or a virtual line) which passes (crosses) in (through) vertical direction a line L3 which passes through an apex of the second projecting portion 71*e* is positioned between the nozzle row N4 and the nozzle row N5 such that the nozzle row N4 and the nozzle row N5 are divided.

When the structure is let to be as described above, since the first projecting portion 71*d* and the second projecting portion 71*e* are provided to the holding body 71*a*, it is possible to separate each ink jetted downward from each of the three groups of nozzle rows N3, N4, and N5, and to guide upon separating the inks of three types or more to the absorber 23. At this time, similarly as in the first embodiment, it is more desirable to let the nozzle row N3 to be a row for the black ink, and the nozzle row N5 to be a row for a light color ink such as yellow ink, and to isolate mutually the nozzle rows N3 and N5. Moreover, since the through portion 71*g* is provided in the plate portion 71*f*, it is possible to guide also the ink jetted on the plate portion 71*f*, to the absorber 23 via the through portion 71*g*. The plurality of the first projecting portions 71*d* and the second projecting portions 71*e* may be provided appropriately according to the number of nozzle rows and the types of ink.

Seventh Embodiment

Figure 15:
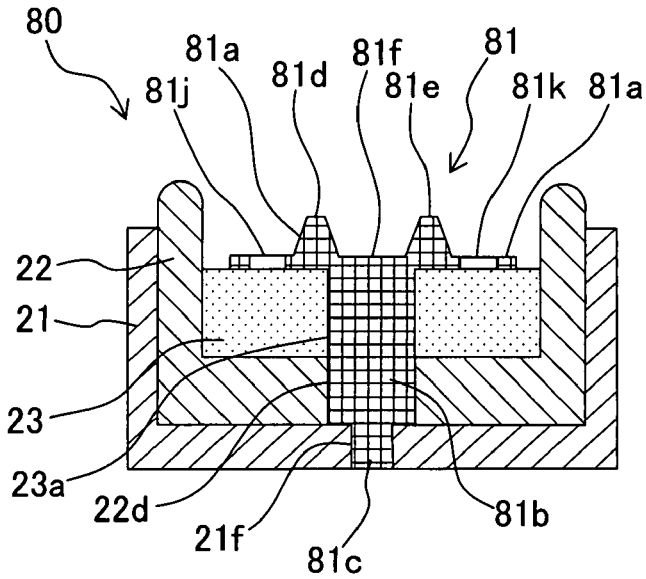
FIG. 15 is a cross-sectional view of a cap apparatus according to a seventh embodiment.
Figure 16:
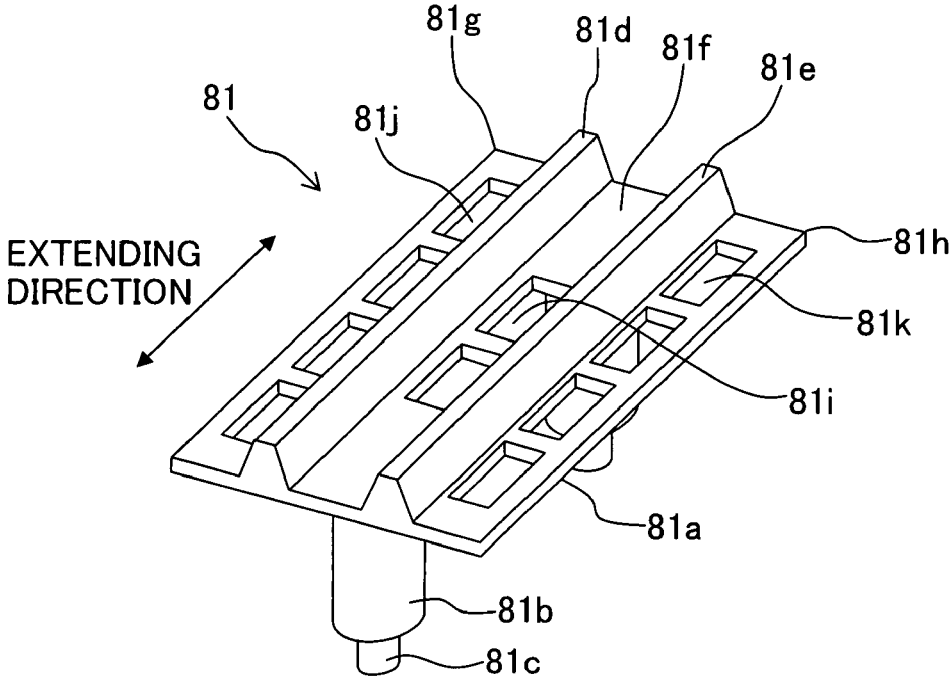
FIG. 16 is a perspective view of a holder of the cap apparatus shown in FIG. 15.

Next, a seventh embodiment of the present invention will be described below. FIG. 15 is a cross-sectional view of a cap apparatus 80 according to the seventh embodiment. FIG. 16 is a perspective view of a holder 81 of the cap apparatus 80 shown in FIG. 15. Since a structure of the cap apparatus 80, except for the holder 81, is similar as the structure of the cap apparatus 10 in the first embodiment, in the following description, same reference numerals are assigned to components similar as in the first embodiment, and detailed description of such components is omitted. As shown in FIG. 15 and FIG. 16, the holder 81 has a holding body 81*a* which makes a contact with the upper surface of the absorber 23, a pair of pins 81*b* which are protruding downward from the holding body 81*a*, and an engaging portion 81*c* which is provided at a lower end of each pin 81*b*. The pin 81*b* and the engaging portion 81*c* are similar as in the first embodiment.

The holding body 81*a* is extended in the longitudinal direction of the absorber 23, and has a first projecting portion 81*d* and a second projecting portion 81*e* at positions corresponding to the lines L2 and L3 in FIG. 14. Each of the first projecting portion 81*d* and the second projecting portion 81*e* is trapezoidal shaped in a cross-sectional viewed in a direction orthogonal to the extending direction, and an upper surface thereof is arranged along the extending direction. A first plate portion 81*f* is provided continuously between the first projecting portion 81*d* and the second projecting portion 81*e*, and two through portions 81*i* arranged along the extending direction open at a central portion of the first plate portion 81*f*. Moreover, a second plate portion 81*g* is provided continuously at a left side direction which is a direction orthogonal to the extending direction of the first projecting portion 81*d*, and four through portions 81*j* arranged along the extending direction open on the second plate portion 81*g*. Furthermore, a third plate portion 81*h* is provided continuously at a right side direction which is a direction orthogonal to the extending direction of the second projecting portion 81*e*, and four through portions 81*k* arranged along the extending direction open on the third plate portion 81*h*.

As described above, since the ink jetted on each of the first plate portion 81*f*, the second plate portion 81*g*, and the third plate portion 81*h* of the holding body 81*a*, is separated by each of the first projecting portion 81*d* and the second projecting portion 81*e*, and is not mixed, it is possible to guide separately the inks of different types to the absorber 23. Furthermore, since the through portions 81*i*, 81*j*, and 81*k* are provided in the first plate portion 81*f*, the second plate portion 81*g*, and the third plate portion 81*h* respectively, it is possible to guide the ink on each of the first plate portion 81*f*, the second plate portion 81*g*, and the third plate portion 81*h* to the absorber 23 via the through portions 81*i*, 81*j*, and 81*k* respectively. Although, the first projecting portion 81*d* and the second projecting portion 81*e* in the seventh embodiment are cross-sectional trapezoidal shaped, the first projecting portion 81*d* and the second projecting portion 81*e* may be acute cross-sectional triangular shaped or a circular arc shaped. Moreover, in addition to the through portions 81*i*, 81*j*, and 81*k*, some through portions may be provided, and these through portions may be provided appropriately according to the types of inks, and at positions where more ink is made to be absorbed.

Eighth Embodiment

Figure 17:
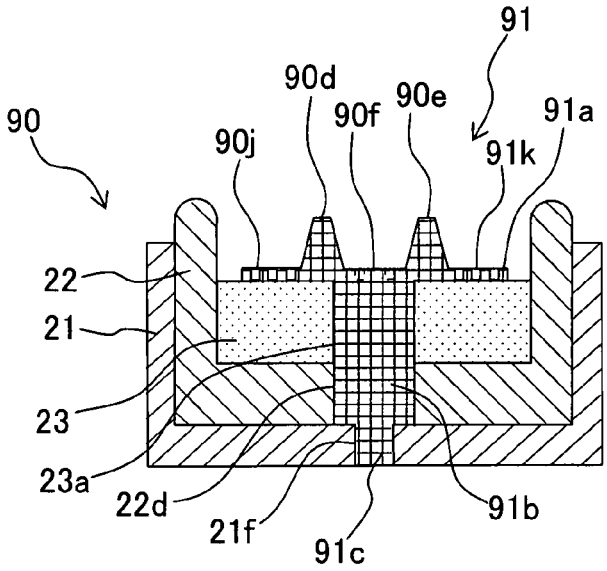
FIG. 17 is a cross-sectional view of a cap apparatus according to an eighth embodiment.
Figure 18:
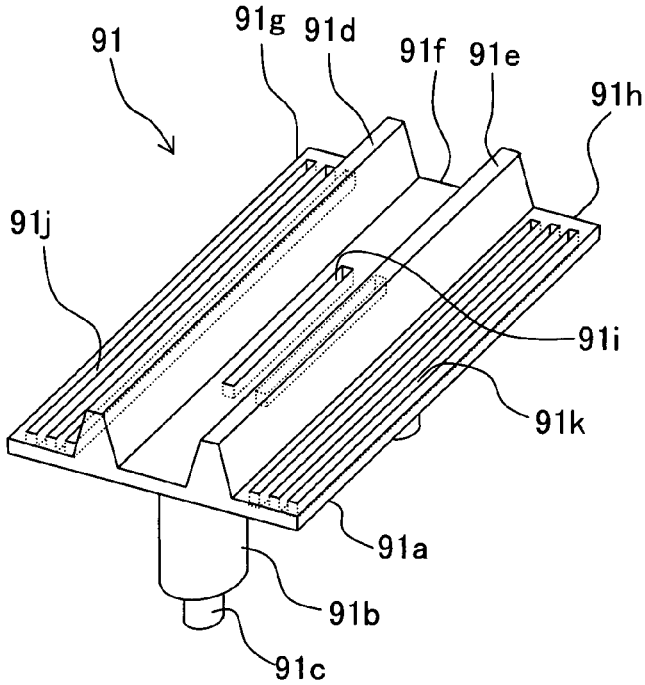
FIG. 18 is a perspective view of a holder of the cap apparatus shown in FIG. 17.

Next, an eighth embodiment of the present invention will be described below. FIG. 17 is a cross-sectional view of a cap apparatus 90 according to the eighth embodiment. FIG. 18 is a perspective view of a holder 91 of the cap apparatus 90. Since a structure of the cap apparatus 90 except for the holder 91 is similar as the structure of the cap apparatus 10 in the first embodiment, in the following description, same reference numerals are assigned to components similar as in the first embodiment, and detailed description of such components is omitted. Furthermore, a pin 91*b*, an engaging portion 91*c*, a first projection portion 91*d*, a second projecting portion 91*e*, a first plate portion 91*f*, a second plate portion 91*g*, and a third plate portion 91*h* shown in FIG. 18 are similar to respective portions in the seventh embodiment.

As shown in FIG. 17 and FIG. 18, a through portion 91*i*, which is in the form of a slit and is extended along each of the first projecting portion 91*d* and the second projecting portion 91*e*, opens at a central portion (a position which does not interfere with the pin 91*b*) of the first plate portion 91*f*. Moreover, through portions 91*j* and 91*k*, which are in the form of a slit and are extended along each of the first projecting portion 91*d* and the second projecting portion 91*e*, open on the second plate portion 91*g* and the third plate portion 91*h*. A slit width of each of the through portions 91*i*, 91*j*, and 91*k*, in a direction orthogonal to the direction of extension has a substantially small size so that ink is sucked through the through portions 91*i*, 91*j*, and 91*k* by a capillary force. In the eighth embodiment, there are two rows of the through portions 91*i*, and three rows each of the through portions 91*j* and 91*k*. However, the through portions may be provided additionally to generate more capillary force, and may be provided appropriately according to the types of inks, at positions where more ink is made to be absorbed.

As described above, since the through portions 91*i*, 91*j*, and 91*k* have a fine (very small) slit width, the capillary force of the through portions 91*i*, 91*j* and 91*k* is increased. Therefore, the flow of ink on each of the first plate portion 91*f*, the second plate portion 91*g*, and the third plate portion 91*h* of the holding body 91*a*, to the absorber 23 is accelerated. Accordingly, the ink jetted from the ink-jet head 4 is guided promptly to the absorber 23, and a suction purge effect is improved.

Ninth Embodiment

Figure 19:
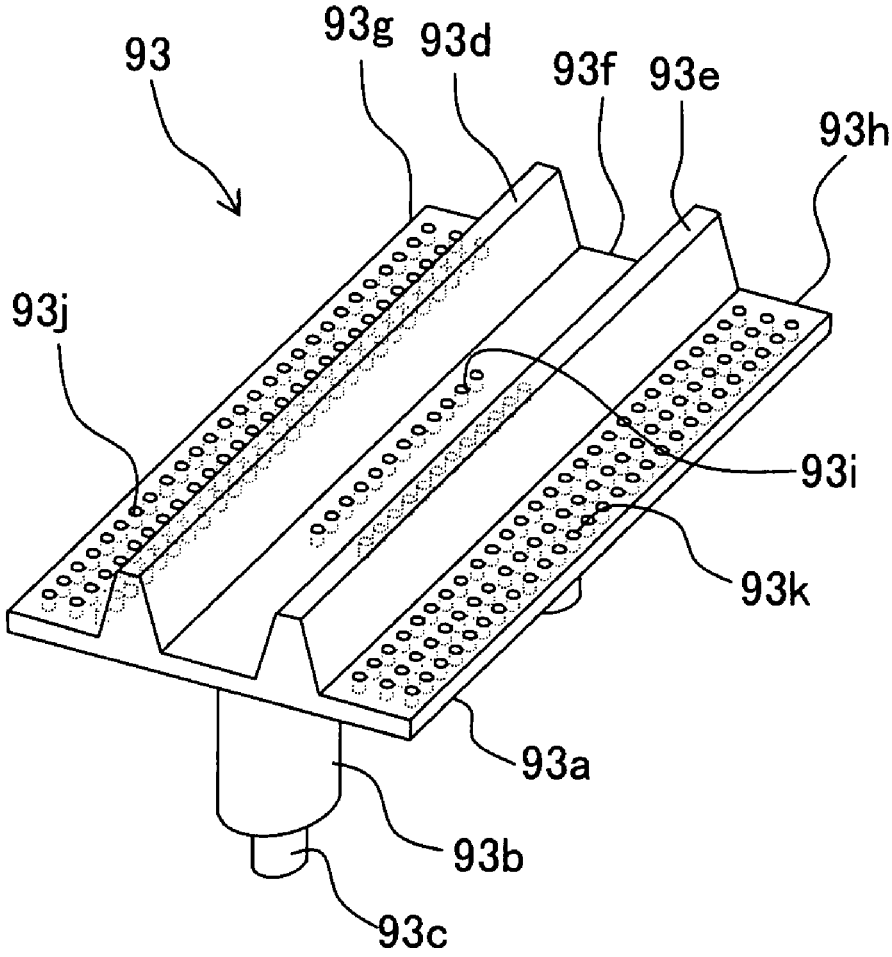
FIG. 19 is a perspective view of a holder of a cap apparatus according to a ninth embodiment.

Next, a ninth embodiment of the present invention will be described below. FIG. 19 is a perspective view of a holder 93 of a cap apparatus according to the ninth embodiment of the present invention. A pin 93*b*, an engaging portion 93*c*, a first projecting portion 93*d*, a second projecting portion 93*e*, a first plate portion 91*f*, a second plate portion 91*g*, and a third plate portion 91*h* shown in FIG. 19 are similar to respective portions in the eight embodiment.

As shown in FIG. 19, a plurality of through portions 93*i*, which are minute circular holes, open at a central portion (a position which does not interfere with the pin 93*b*) of the first plate portion 93*f*. Moreover, a plurality of through portions 93*j* and 93*k*, which are minute circular holes, open on the second plate portion 93*g* and the third plate portion 93*h*.

As described above, the flow of ink on each of the first plate portion 93*f*, the second plate portion 93*g*, and the third plate portion 93*h* of the holding main body 93*a*, to the absorber 23 is accelerated due to the capillary force of the through portions 91*i*, 91*j*, and 91*k* which are minute holes. Accordingly, the ink jetted from the ink-jet head 4 is guided promptly to the absorber 23, and the suction purge effect is improved.

Moreover, in the embodiments described above, the cap 22 covers the entire nozzle surface 4*a* by the surrounding-wall 22*a*, and can also be used in a cap in which a partition wall which divides the surrounding-wall 22*a* along the black-ink nozzle row N1 and the color-ink nozzle row N2 in FIG. 6 is provided. Even though such a cap apparatus has a simple structure, it is possible to vent the compressed air which is generated at the time of assembling the cap apparatus 10. In addition, when the holder 24 is arranged to correspond to the color-ink nozzle row N2, it is also possible to suppress the mixing of colors at the time of purge for each color ink.

As it has been described above, the cap apparatus and a liquid jetting apparatus according to the present invention have an excellent effect in improving an assembling workability, and is applicable to a liquid jetting apparatus such as an ink-jet printer which is capable of exerting the significance of this effect.

What is claimed is:

1. A cap apparatus which covers a nozzle surface, of a liquid jetting head, in which a plurality of nozzles jetting a liquid is formed, the cap apparatus comprising:

a cap holder which includes a first recess formed therein, and a first through hole formed in a bottom of the first recess;

a cap which is accommodated inside the first recess to seal the nozzle surface, which is formed by an elastic member having a second recess formed therein, and which has a second through hole communicating with the first through hole and formed in a bottom of the second recess;

an absorber which is accommodated inside the second recess of the cap to absorb the liquid, and which includes a third through hole communicating with the first through hole and the second through hole and formed to penetrate through a lower surface up to an upper surface of the absorber, the lower surface facing the bottom of the second recess; and a holding member which holds the absorber and the cap and which has a contacting portion which makes a contact with the upper surface of the absorber, a pin which protrudes from the contacting portion, and an engaging portion which is provided on a front end of the pin;

wherein the pin is inserted through the second through hole and the third through hole, and the engaging portion is engaged with the first through hole, so that the absorber and the cap are clamped between the contacting portion and the cap holder.

2. The cap apparatus according to claim 1;

wherein the engaging portion of the holding member is a projection having a diameter smaller than a diameter of the pin; and the engaging portion is press-fit into the first through hole to fix the holding member to the cap holder.

3. The cap apparatus according to claim 1;

wherein the liquid jetting head includes a plurality of nozzle rows which jet a plurality of liquids, respectively, and each of the nozzle rows is extended in a predetermined direction;

the holding portion is extended in the predetermined direction, and is arranged to face the nozzle rows; and the holding portion has a projecting portion which is projected upward, and is arranged corresponding to a position at which the nozzle rows are divided as viewed from a direction orthogonal to the predetermined direction.

4. The cap apparatus according to claim 3;

wherein the projecting portion of the contacting portion is projected upward at a center thereof, in a cross-section, of the contacting portion, orthogonal to the predetermined direction.

5. The cap apparatus according to claim 3;

wherein the projecting portion of the contacting portion has a plurality of projections which divide the nozzle rows in a cross-section orthogonal to the predetermined direction;

the contacting portion further includes a plate member which is provided to continue to each of the projections; and a through hole penetrating through the plate member in a vertical direction is formed in the plate member.

6. The cap apparatus according to claim 5;

wherein the plurality of projections is arranged at predetermined intervals, and the through hole formed in the plate member is formed as a plurality of communicating holes arranged along the predetermined direction, and arranged between the projections and on both sides of the projection respectively.

7. The cap apparatus according to, claim 6;

wherein each of the communicating holes is formed as a slit extending in the predetermined direction.

8. The cap apparatus according to claim 6;

wherein each of the communicating holes is formed as a plurality of communicating-hole rows each extending in the predetermined direction; and each of the communicating-hole rows is arranged along a direction orthogonal to the predetermined direction.

9. The cap apparatus according to claim 3;

wherein a cross-section of the projecting portion which is orthogonal to the predetermined direction has a shape which is selected from a group consisting of a circular arc shape, a triangular shape, and a trapezoidal shape.

10. The cap apparatus according to claim 3;

wherein the projecting portion has two triangular-pillar shaped projections extended in the predetermined direction; the two projections are arranged at a predetermined interval; and a through hole which guides the liquid to the absorber is formed between the two projections of the projecting portion.

11. The cap apparatus according to claim 1;

wherein a water repellent layer is formed on an upper surface of the contacting portion.

12. The cap apparatus according to claim 1;

wherein a suction hole which propagates a negative pressure from an outside to a space which is sealed by the liquid jetting head and the cap is formed penetrating through the bottom of the first recess of the cap holder and the bottom of the second recess of the cap.

13. The cap apparatus according to claim 1;

wherein a diameter of the first through hole is smaller than a diameter of the second through hole and a diameter of the third through hole; and a diameter of the pin is smaller than those of the second and the third through holes, and is larger than that of the first through hole.

14. The cap apparatus according to claim 1;

wherein the first through hole serves as an air-vent hole.

15. The cap apparatus according to claim 1;

wherein the first through hole, the second through hole, and the third through hole are respectively formed as a plurality of holes, and a plurality of pins protrudes from the contacting portion.

16. A liquid jetting apparatus which jets a liquid, comprising:

a liquid jetting head having a nozzle surface in which a plurality of nozzles jetting a liquid is formed;

a cap apparatus covering a nozzle surface of the liquid jetting head and including:

a cap holder which includes a first recess formed therein, and a first through hole formed in a bottom of the first recess;

a cap which is accommodated inside the first recess to seal the nozzle surface, which is formed by an elastic member having a second recess formed therein, and which has a second through hole communicating with the first through hole and formed in a bottom of the second recess;

an absorber which is accommodated inside the second recess of the cap to absorb the liquid, and which includes a third through hole communicating with the first through hole and the second through hole and formed to penetrate through a lower surface up to an upper surface of the absorber, the lower surface facing the bottom of the second recess; and a holding member which holds the absorber and the cap and which has a contacting portion which makes a contact with the upper surface of the absorber, a pin which protrudes from the contacting portion, and an engaging portion which is provided on a front end of the pin; and a suction unit which generates a negative pressure;

wherein the pin is inserted through the second through hole and the third through hole, and the engaging portion is engaged with the first through hole, so that the absorber and the cap are clamped between the contacting portion and the cap holder;

wherein a suction hole which propagates the negative pressure to a space which is sealed by the liquid jetting head and the cap body is formed penetrating through the bottom of the first recess of the cap holder and the bottom of the second recess of the cap body; and wherein the suction unit is connected to the suction hole.

17. The liquid jetting apparatus according to claim 16;

wherein the first through hole serves as an air-vent hole.

18. The liquid jetting apparatus according to claim 16;

wherein the first through hole, the second through hole, and the third through hole are respectively formed as a plurality of holes, and a plurality of pins protrudes from the contacting portion.

* * * * *